US010151068B2

(12) United States Patent
Widlroither

(10) Patent No.: US 10,151,068 B2
(45) Date of Patent: Dec. 11, 2018

(54) HAND-HELD TAMPER FOR UNDERFILLING BALLAST OF A TRACK

(75) Inventor: Otto Widlroither, Freilassing (DE)

(73) Assignee: Robel Bahnbaumaschinen GmbH, Freilassing (DE)

( * ) Notice: Subject to any disclaimer, the term of this patent is extended or adjusted under 35 U.S.C. 154(b) by 968 days.

(21) Appl. No.: 14/124,432

(22) PCT Filed: Jul. 20, 2012

(86) PCT No.: PCT/EP2012/003057
§ 371 (c)(1),
(2), (4) Date: Feb. 26, 2014

(87) PCT Pub. No.: WO2013/017210
PCT Pub. Date: Feb. 7, 2013

(65) Prior Publication Data

US 2014/0224146 A1 Aug. 14, 2014

(30) Foreign Application Priority Data

Aug. 3, 2011 (DE) ..... 20 2011 103 985 U

(51) Int. Cl.
*E01B 27/20* (2006.01)
*E01B 27/14* (2006.01)
*E01B 1/00* (2006.01)

(52) U.S. Cl.
CPC ..... *E01B 27/20* (2013.01); *E01B 1/001* (2013.01); *E01B 27/14* (2013.01)

(58) Field of Classification Search
CPC ..... E01B 27/14; E01B 27/16; E01B 27/20; E01B 27/26; B25D 17/00
USPC ..... 104/13
See application file for complete search history.

(56) References Cited

U.S. PATENT DOCUMENTS 2,137,842 A * 11/1938 Jackson ..... E01B 27/14 104/13
2,239,785 A * 4/1941 Jackson ..... E01B 27/14 104/13
2,892,417 A * 6/1959 Jackson ..... E01B 27/14 104/13
2,973,719 A * 3/1961 Plasser ..... E01B 27/16 104/12
3,093,089 A * 6/1963 Fleing ..... E01B 27/14 104/14

(Continued)

FOREIGN PATENT DOCUMENTS

AT 239296 B 3/1965
DE 1218486 B 6/1966

(Continued)

*Primary Examiner* — Zachary L Kuhfuss
(74) *Attorney, Agent, or Firm* — Laurence A. Greenberg; Werner H. Stemer; Ralph E. Locher

(57) ABSTRACT

A hand-held tamper for underfilling ballast of a track. The tamper has a drive motor for the rotation of an unbalance and a tamping shovel fastened to a lower end of a shaft which is joined to the drive motor and has a longitudinal axis. The shovel consists of two shovel halves each joined to the shaft. Each shovel half has an upper shovel part nearer to the drive motor and a lower shovel part positioned at a first angle <180° in relation thereto. Both shovel halves are disposed at a second angle <180° relative to one another when viewed in the direction of the longitudinal axis of the shaft.

9 Claims, 2 Drawing Sheets

(56) References Cited

U.S. PATENT DOCUMENTS

| | | | | | |
|---|---|---|---|---|---|
| 3,396,671 | A * | 8/1968 | Roseberry | E01B 27/16 | 104/13 |
| 3,729,055 | A * | 4/1973 | Burridge | E01B 27/16 | 104/10 |
| 3,736,879 | A * | 6/1973 | Anderson | E01B 27/16 | 104/12 |
| 4,922,828 | A * | 5/1990 | Theurer | E01B 27/16 | 104/10 |
| 6,978,718 | B2 * | 12/2005 | Seyrlehner | E01B 27/16 | 104/10 |
| 2013/0263755 | A1 * | 10/2013 | Widlroither | E01B 27/20 | 104/13 |
| 2013/0269563 | A1 * | 10/2013 | Widlroither | E01B 27/14 | 104/13 |
| 2015/0373895 | A1 * | 12/2015 | Bartnik | A01B 1/022 | 56/400.04 |

FOREIGN PATENT DOCUMENTS

| | | | |
|---|---|---|---|
| GB | 977345 | A | 12/1964 |
| GB | 1038518 | A | 8/1966 |

* cited by examiner

HAND-HELD TAMPER FOR UNDERFILLING BALLAST OF A TRACK

BACKGROUND OF THE INVENTION

Field of the Invention

The invention relates to a hand-held tamper for underfilling the ballast of a track, with a drive motor for the rotation of an unbalance and a tamping shovel fastened to a lower end of a handle which is joined to the drive motor and has a longitudinal axis.

A hand-held tamper of this kind is already known by way of example from AT 239 296. The handle is thereby designed as a tubular shaft provided at the lower end with the unbalance. The tamping shovel is designed in the form of a slightly curved plane.

BRIEF SUMMARY OF THE INVENTION

The object of the present invention is now to provide a hand-held tamper of the type already mentioned with which an improved compacting action can be achieved.

According to the invention, this object is achieved with a hand tamper of the specified type by way of the features as claimed.

With such a design of the tamping shovel its lower section runs approximately in the insertion direction of the hand-held tamper into the ballast. The upper section of the tamping shovel leads as a further result to an additional compacting of the ballast. Through the angular arrangement of the two shovel halves relative to one another it is possible to reduce any sideways sliding of the ballast.

Further advantages of the invention are apparent from the dependent claims and the description of the drawing.

BRIEF DESCRIPTION OF THE SEVERAL VIEWS OF THE DRAWING

The invention will now be described in further detail with reference to the embodiments illustrated in the drawing.

These show.

DESCRIPTION OF THE INVENTION

Figure 2:
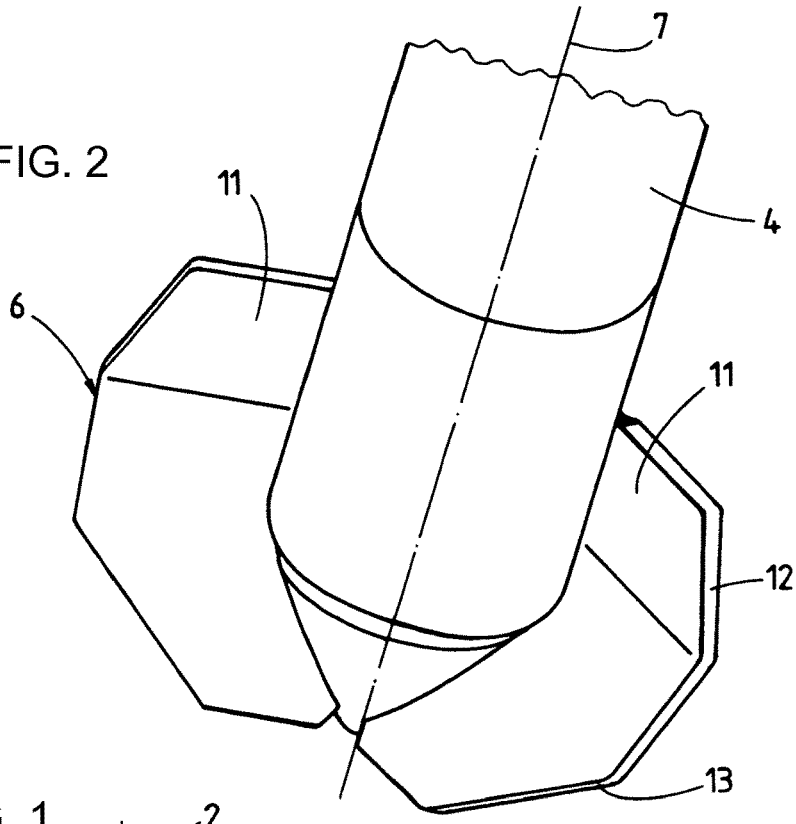
FIGS. 2 to 5 different enlarged views of a tamping shovel.
Figure 1:
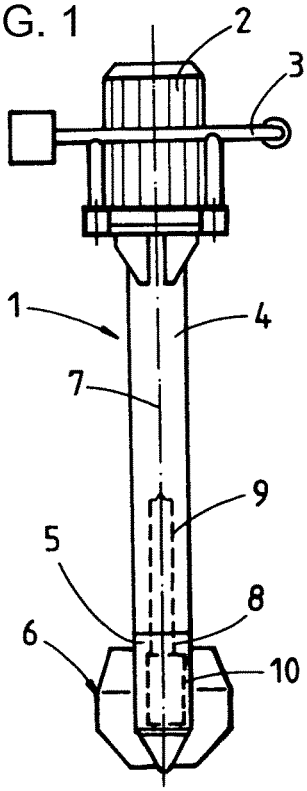
FIG. 1 a view of a hand-held tamper.
Figure 3:
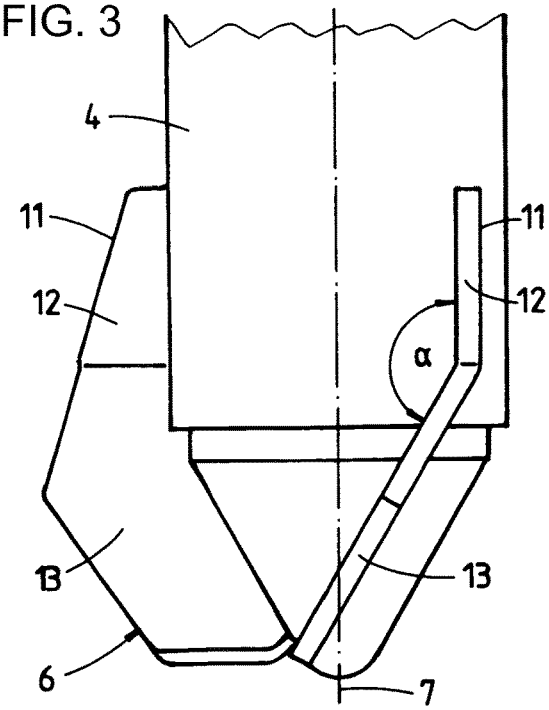

A hand-held tamper 1 illustrated in FIG. 1 has a drive motor 2 which is connected to handle grips 3 and to a handle shaft 4 which has a longitudinal axis 7. A tamping shovel 6 is provided at a lower end 5 of the handle 4 spaced from the drive motor 2. In the handle 4 there is a shaft 9 mounted rotatable about the longitudinal axis 7 by the drive motor 2. This shaft has at the lower end 8 remote from the drive motor 2 an unbalance 10 for generating tamping vibrations.

As can be seen in FIGS. 2 to 5, the tamping shovel 6 consists of two shovel halves 11 each connected to the handle 4. Each of these two shovel halves 11 has an upper shovel part 12, which is nearer to the drive motor 2 and runs parallel to the longitudinal axis 7, and a lower shovel part 13. The two shovel parts 12, 13 include an angle $\alpha$ of <180°, preferably 150°. The angle $\alpha$ can vary in the region of between about 100° and 180°, depending on the design of the hand-held tamper 1.

Figure 4:
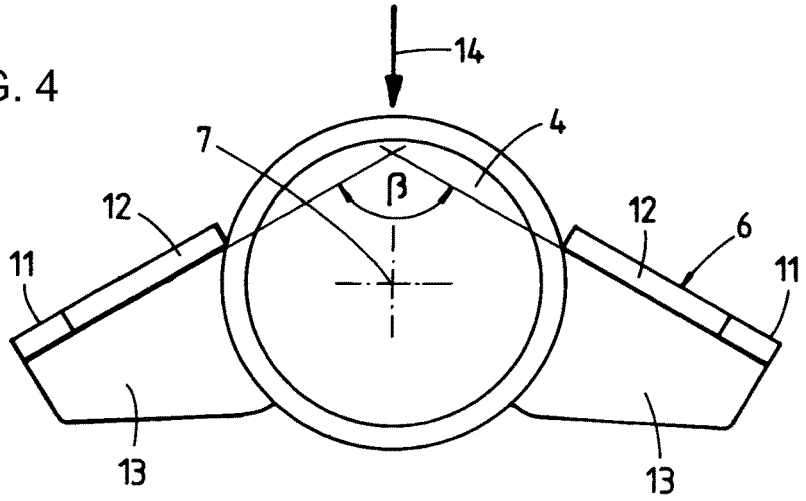
Figure 5:
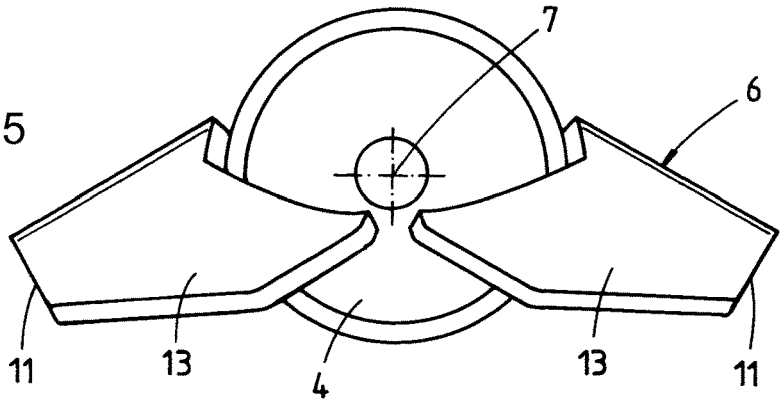

Both shovel halves 11—seen in the direction of the longitudinal axis 7 of the handle 4 (see FIG. 4)—are arranged at an angle $\beta<180°$, preferably 120°, relative to one another. The angle $\beta$ can vary in the region from about 110° to about 170°, depending on the design of the hand-held tamper 1. The tamper direction is indicated in FIG. 4 by an arrow 14.

Figure 6:
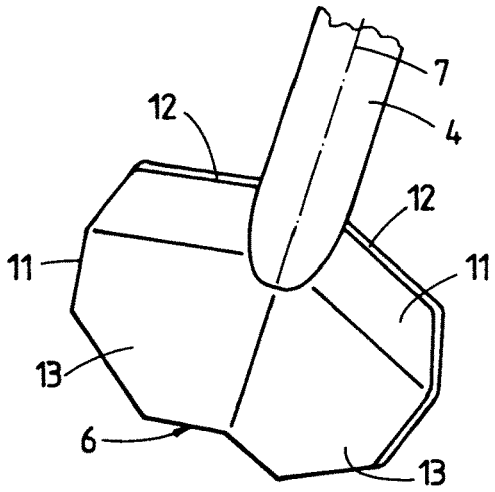
FIG. 6 a further variation of a tamping shovel.

With the variation of the invention which is shown in FIG. 6 only the two upper shovel parts 12 are joined to the handle 4. The lower shovel parts 13 are welded both to one another and also to the adjoining upper shovel part 12. This variation is particularly suitable for a hand-held tamper, whose unbalance is positioned in the region of the drive motor.

The invention claimed is:

1. A hand-held tamper for tamping ballast of a track, the tamper comprising:

a drive motor for rotation of an imbalance;

a shaft connected to said drive motor, said shaft having a lower end and a longitudinal axis;

a tamping blade fastened to said lower end of said shaft;

said tamping blade having two blade halves each connected to said shaft;

each of said blade halves having an upper blade part and a lower blade part, with said upper blade part being positioned closer to said drive motor than said lower blade part and said upper and lower blade parts enclosing an angle $\alpha<180°$ with regard to one another; and said blade halves enclosing an angle $\beta<180°$ with regard to one another, when viewed in a direction of the longitudinal axis of said shaft.

2. The hand tamper according to claim 1, wherein said tamping blade consists of said two blade halves.

3. The hand tamper according to claim 1, wherein said angle $\alpha$ lies between 100° and 180°.

4. The hand tamper according to claim 3, wherein said angle $\alpha$ amounts to 150°.

5. The hand tamper according to claim 1, wherein said angle $\beta$ lies between 110° and 170°.

6. The hand tamper according to claim 5, wherein said angle $\beta$ amounts to 120°.

7. A hand-held tamper for tamping ballast of a track, the tamper comprising:

a drive motor for rotation of an imbalance;

a shaft connected to said drive motor, said shaft having a lower end and a longitudinal axis;

a tamping blade fastened to said lower end of said shaft, said tamping blade having two blade halves each connected to said shaft;

said two blade halves projecting laterally from said shaft and being disposed mirror-symmetrically on opposite sides of said longitudinal axis;

each of said blade halves having an upper blade part and a lower blade part, with said upper blade part being positioned closer to said drive motor than said lower blade part and said upper and lower blade parts enclosing an angle $\alpha<180°$ in a substantially vertical direction with regard to one another; and said blade halves enclosing an angle $\beta<180°$ with regard to one another, when viewed in a direction of the longitudinal axis of said shaft in a substantially horizontal direction.

8. The hand tamper according to claim 7, wherein said blade halves are separately welded to said shaft, with said upper blade parts and said lower blade parts of said blade halves being welded directly to said shaft.

9. The hand tamper according to claim 7, wherein said upper blade part of each of said blade halves is welded to said shaft and said lower blade parts of said blade halves are welded directly to one another.

* * * * *